United States Patent [19]

Reimert

[11] Patent Number: 5,076,356

[45] Date of Patent: Dec. 31, 1991

[54] WELLHEAD EQUIPMENT

[75] Inventor: Larry E. Reimert, Houston, Tex.

[73] Assignee: Dril-Quip, Inc., Houston, Tex.

[21] Appl. No.: 370,234

[22] Filed: Jun. 21, 1989

[51] Int. Cl.[5] ..... E21B 33/03

[52] U.S. Cl. ..... 166/115; 166/182; 166/208; 285/140

[58] Field of Search ..... 166/208, 182, 115, 191, 166/86; 285/140, 139, 141, 143; 277/236, 235 R, 117, 118, 188 R, 188 A, 191, 206 R

[56] References Cited

U.S. PATENT DOCUMENTS

| | | | |
|---|---|---|---|
| 3,920,071 | 11/1975 | Cegielski | 166/208 X |
| 4,407,530 | 10/1983 | Fowler | 285/140 |
| 4,550,782 | 11/1985 | Lawson | 285/140 X |
| 4,691,780 | 9/1987 | Galle, Jr. et al. | 166/208 X |
| 4,719,971 | 1/1988 | Owens | 166/191 |
| 4,722,391 | 2/1988 | Brammer | 166/208 X |
| 4,757,860 | 7/1988 | Reimert | 166/208 |
| 4,766,956 | 8/1988 | Smith et al. | 166/208 X |
| 4,781,387 | 11/1988 | Brangh | 277/235 R |
| 4,815,770 | 3/1989 | Hyne et al. | 285/140 |
| 4,823,871 | 4/1989 | McEver et al. | 166/182 |
| 4,842,061 | 7/1989 | Nobilean | 166/115 |

*Primary Examiner*—Hoang C. Dang

*Attorney, Agent, or Firm*—Vaden, Eickenroht, Thompson & Boulware

[57] ABSTRACT

There are disclosed several embodiments of wellhead equipment wherein a seal assembly is installed within a frusto-conically shaped space between the bore of a first wellhead member and a conically shaped surface about a second wellhead member to close same. In one embodiment, the first member is a casing hanger landed within the bore of a subsea casing head, the second member is a tubing hanger within the head, and the seal assembly closes off a space between the bore of the casing hanger and the outer surface of the tubing hanger. In another embodiment, the first member is a surface casing head, the second member is a tubing hanger landed within the bore of the head, and the seal assembly closes off a space between the bore and hanger. In a further embodiment, the first member is a Christmas tree adapter of a surface wellhead landed on a casing head, the second member is a tubing hanger landed in the bore of the head and having an upper extension within a counterbore of the adapter, and the seal assembhly closes off a space between the counterbore of extension.

24 Claims, 5 Drawing Sheets

20
21
28
29
34
51
50
23
27
26
30
25
32
31
22
24

WELLHEAD EQUIPMENT

This invention relates generally to wellhead equipment or other apparatus wherein an annular space between a first member having a bore therethrough and a second member having an outer surface disposable concentrically within the bore is adapted to be closed by a seal assembly which forms a metal-to-metal seal with the bore and outer surface. More particularly, it relates to improvements in wellhead equipment or other apparatus of this type wherein, as shown in U.S. Pat. No. 4,757,860, assigned to the assignee of the present application, the outer surface of the second member is conically shaped to form a frusto-conically shaped space between it and the bore of the first member, and the seal assembly comprises a metal body having a relatively thin inner wall which is slidable over the outer surface to cause it to flex outwardly and thus force the outer ends of upwardly and outwardly and downwardly and outwardly extending legs about the the outer side of the wall into tight engagement with the bore. In one of its novel aspects, this invention relates to such equipment in which the first member is a casing hanger landable within the bore of a housing or head of a subsea wellhead and the second member is a tubing hanger landable within the housing bore above the casing hanger for suspending a tubing string within the casing string suspended from the casing hanger.

In the particular embodiment of the aforementioned U.S. patent, the first member is a subsea casing head or housing connected to an outermost casing of a subsea well, and having a seat about its bore, and the second member is a casing hanger having a shoulder thereabout and adapted t be lowered into the bore on a running tool for landing on the seat so as to suspend a casing string connected to the hanger body within the outermost casing. The casing hanger body has flow passages through it to permit cement returns to be circulated upwardly through the annulus between the casings, and the seal assembly is also carried by the running tool for lowering with the casing hanger, and then, upon landing of the hanger, downward movement into the frusto-conical space between an outer surface of the hanger and the bore of the head so as to close the space and thus the flow passages.

As disclosed in the aforementioned patent, the seal assembly also includes one or more seal rings or packing of elastomeric material which surround the inner wall of the metal body and are so arranged with respect to the legs about its outer side as to be expanded into tight sealing engagement with the bore of the second member as the legs are forced outwardly against the well bore. Equipment including a seal assembly of this construction is an improvement over prior apparatus of this general type in several respects, for reasons fully discussed in such patent.

There are other types of subsea wellhead equipment wherein there is similar need for a seal assembly of this type. Thus, for example, it may be necessary to close flowways through a tubing hanger adapted to suspend a tubing string within an inner casing string suspended from a casing hanger landed within a subsea casing head. However, in this and other types of wellhead equipment, as well as other apparatus of this type, it may not be possible to lower the seal assembly into the annular space to be closed by means of a remotely actuated running tool, as in the case of the equipment of U.S. Pat. No. 4,757,860. Thus, the tubing hanger above the space between it and the bore of the casing hanger fits closely within the bore of the head, such that the tubing hanger may be locked down with the head by suitable locking parts on the hanger engagable with the head. However, to close off an annular space between the tubing hanger and bore of the head would expose the seal assembly which closes the annular space between the casing hanger and head to pressure within the annulus between the casing and tubing strings Thus, it may be preferred, if not necessary, to close off an annular space between the bore of the casing hanger and the outer surface of the tubing hanger, and thus close flowways through the tubing hanger through which cement returns in the casing/tubing annulus are circulated.

There are still other types of wellhead equipment, such as surface rather than subsea wellheads in which there is a need for closing off an annular space between the bore of a first member and an outer surface of a second member disposable concentrically within the bore, but wherein, as in the subsea wellhead above described, the members are so arranged that the seal assembly may not be lowered into the space, or in which the space is easily accessible, but in which a complex, remotely actuated running tool is not required to install and set the seal assembly.

The object of this invention is to provide such wellhead equipment or other apparatus of this type in which the seal assembly may be installed and set within the space between the first and second members, such as between the tubing hanger and casing hanger of a subsea wellhead, in a relatively easy manner, and, more particularly, without the need for a remotely actuated running tool or other complex auxiliary equipment.

This and other objects are accomplished, in accordance with the illustrated embodiments of the present invention, by apparatus of the type described wherein one of the members has means for causing the seal assembly body and second member to move in one longitudinal direction with respect to one another whereby the inner conical side of the inner wall of the annular metal body of the seal assembly slides over the conical surface of the second member, and thus flexes the inner wall outwardly, and wherein the seal assembly has means which is engagable with the second member to limit outward flexing of the inner wall when the outer ends of the legs have been forced into tight sealing engagement with the bore of the first member. Thus, as previously mentioned, the apparatus of this invention permits the installation and setting of the seal assembly in environments in which the seal assembly may not be moved into the space between the bore and outer surface, or in which a remotely actuated running tool is not necessary to installation of the seal assembly.

In certain embodiments of the invention, the means for causing such movement comprises a shoulder on the first member at one end of the bore therein which is engagable with a shoulder on the seal assembly body, as the first member is moved in the one longitudinal direction with respect to the second member so as to dispose the outer surface of the second member concentrically within the bore of the first member.

In one such embodiment, the shoulder on the first member extends outwardly from its bore toward the bore of the casing head, and the shoulder on the seal assembly body extends inwardly from its conical surface and opposite the shoulder on the first member, such that, as above noted, the seal assembly may not be moved into the space between the casing hanger body and tubing hanger body. Thus, the second member may be a tubing hanger to which the seal assembly is releasably connected for lowering with it, and the first member may be a casing hanger body landed in the bore of a subsea casing head in which the tubing hanger is to be landed.

In another such embodiment, the seal assembly is carried by the second member, and the shoulder extends inwardly of the bore of said first member such that the seal assembly may not be lowered into the space. Thus, the bore of the first member is movable longitudinally over the seal assembly body. More particularly, the second member may comprise an upward extension of a tubing hanger, and the first member may comprise a Christmas tree adapter having a counterbore which is lowered over and sealed with respect to the upward extension.

In still another embodiment of the invention, the second member has a first part on which the conical surface is formed and a second part which is movable longitudinally with respect to the first part, and the means for moving the seal assembly body comprises a shoulder on the second part engagable with the shoulder on the seal assembly body, as the second part is moved in the one longitudinal direction with respect to the first part, to cause the seal assembly body to slide over the conical outer surface of the second member. As illustrated, the first member may comprise a surface casing head, and the second member may comprise a tubing hanger which is disposable within the bore of the casing head with its outer surface spaced from the bore thereof. More particularly, the tubing hanger comprises a nut which, in the case of a surface wellhead, is easily accessible from the upper end of the casing head bore, thus not requiring a long and complex running tool manipulation.

In the preferred embodiments of the invention, as in the case of the aforementioned patent, resilient seal means is disposed about the outer side of the inner wall of the seal assembly body above the first leg and below the second leg for sealably engaging the bore, and resilient means is also disposed about the inner side of the inner wall for sealably engaging the outer surface of the second member. More particularly, in the illustrated embodiment of the seal assembly, the second leg is above the first leg and the resilient seal means about the outer side of the inner wall comprises a seal member confined within a recess between the first and second legs.

In the drawings, wherein like reference characters are used throughout to designate like parts:

FIG. 1 is a vertical sectional view of a portion of a subsea wellhead constructed in accordance with one such embodiment of the present invention, and including a tubing hanger landed upon a casing hanger within the bore of a casing head or housing, and showing a seal assembly within an annular space between the bore of the casing hanger and an outer surface of the tubing hanger so as to close same;

Figures 5, 6:
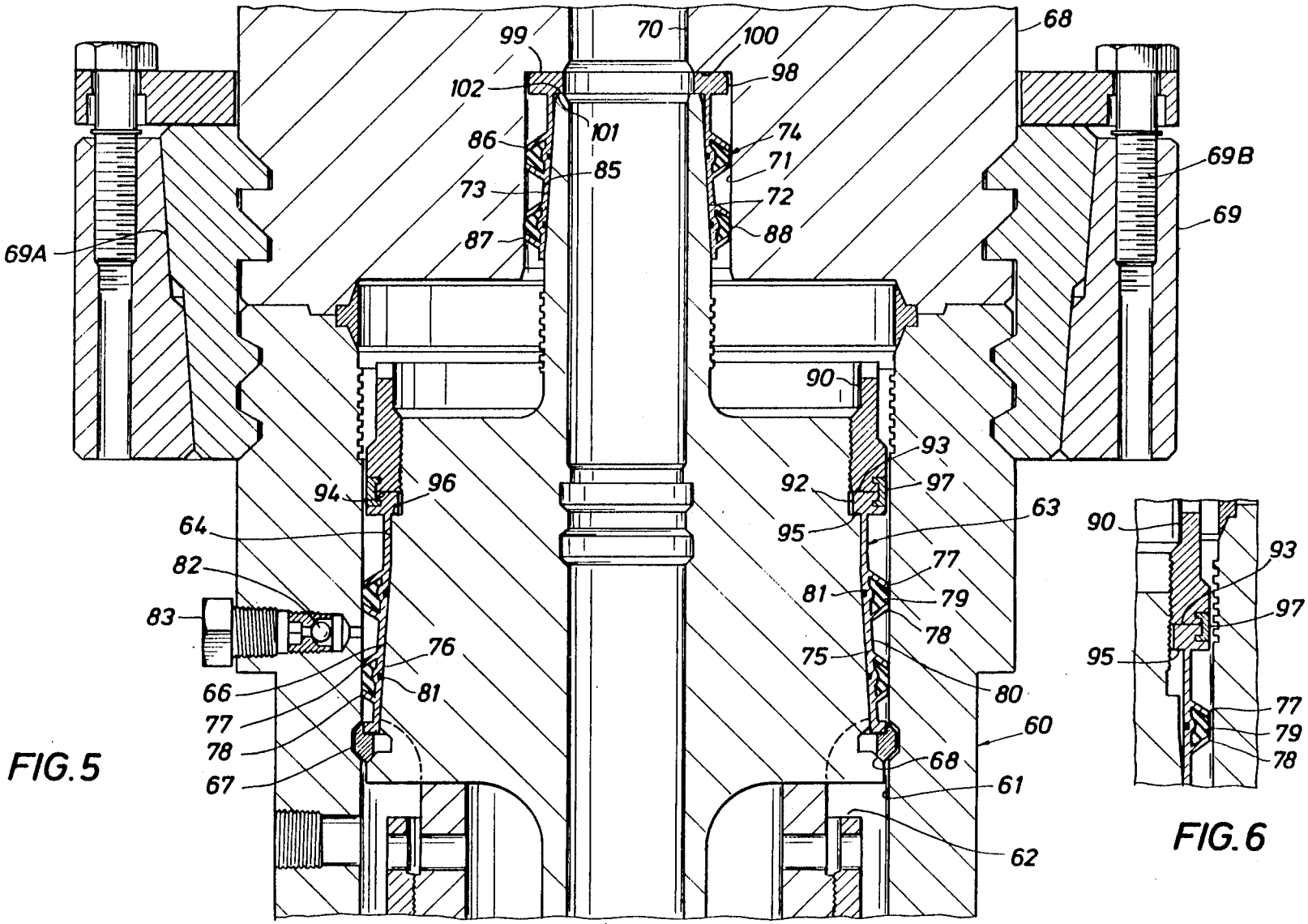
Figure 7:
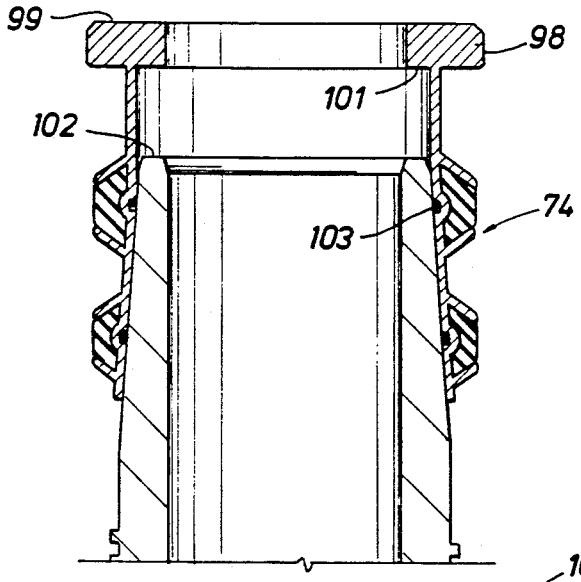
Figure 8:
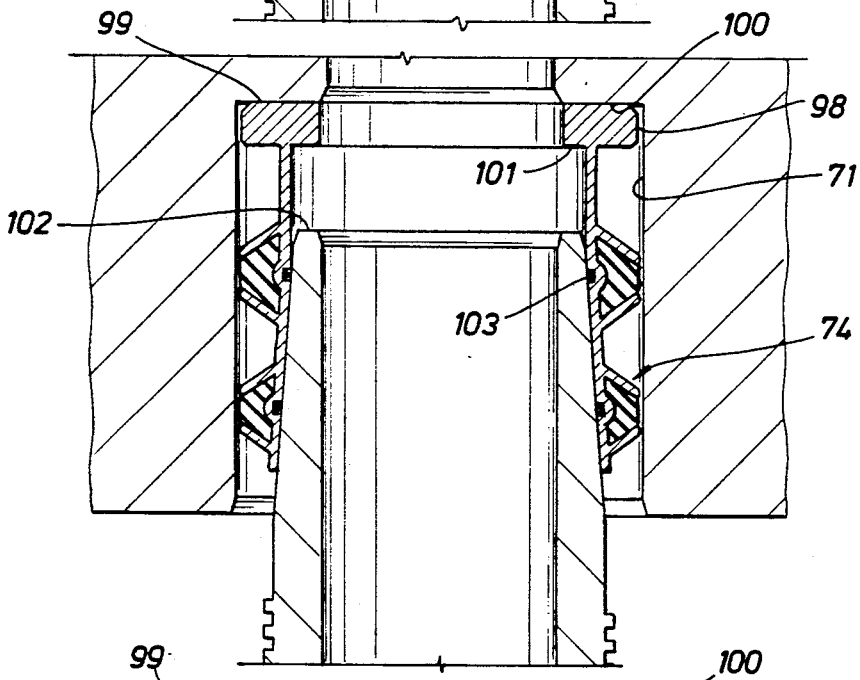
Figure 9:
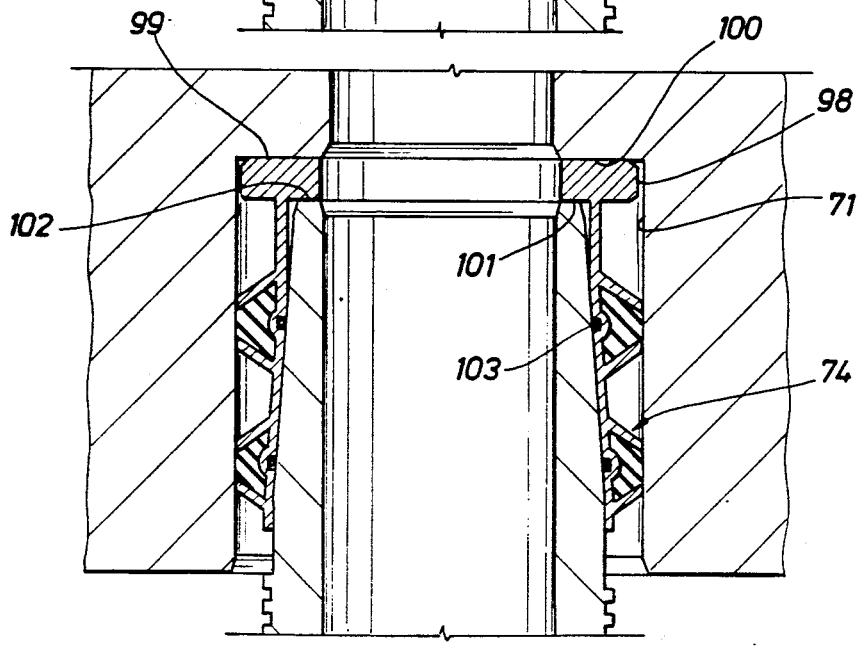

FIG. 5 is a vertical sectional view of a portion of a surface wellhead construction in accordance with another embodiment of the invention and including a tubing hanger landed on a casing hanger within the bore of the casing head or housing and a tree adapter connected to the upper end of the casing head above the tubing hanger, and showing seal assemblies installed within the space between the tubing hanger and the bore of the head as well as between an upper extension of the tubing hanger and a counterbore in the lower end of the tree adapter so as to close the annular spaces between the tubing hanger and the head and tree adapter, respectively;

FIG. 6 is a view of a portion of the wellhead of FIG. 5, and showing the seal assembly for closing the space between the tubing hanger upon lowering of the tubing hanger into the bore of the casing head, but prior to lowering of the seal assembly to cause it to flex outwardly for sealably engaging the bore of the casing head;

FIG. 7 is a view of the upper end of the extension of the tubing hanger with the seal assembly carried thereon prior to installation and connection of the tree adapter to the upper end of the casing head;

FIG. 8 is a view similar to FIG. 7 but upon lowering the counterbore of the tree adapter over the seal assembly carried on the tubing hanger extension; and FIG. 9 is a view similar to FIG. 8, but upon further lowering of the tree adapter into connection with the upper end of the wellhead, to cause the seal assembly to be flexed into sealing engagement between the tubing hanger extension and counterbore of the tree adapter, as shown in FIG. 5.

With reference now to the details of the above described drawings, the subsea wellhead of FIGS. 1 to 4 is shown to comprise a casing head or housing 20 having a bore 21 therethrough and adapted to be installed at the subsea floor with its lower end connected to an outermost casing (not shown) which extends downwardly from the casing head into the wellbore. The upper end of the casing head (also not shown) is adapted for connection to a blowout preventer stack which is in turn connected to a riser pipe which extends upwardly to the water surface.

A casing hanger 22 is shown lowered into and landed within the bore of the casing head for suspending a casing string connected thereto within an outer casing suspended from another casing hanger on which the casing hanger 22 has been landed. The casing hanger 22 comprises a body 23 having passages 24 therethrough which connect the annular space between the inner and outer casings within an annular space 25 between the bore of the casing head and an outer surface 26 of the casing hanger body 23. As described in the aforementioned prior U.S. Pat. No. 4,757,860, this annular space is adapted to be closed, following landing of the hanger, and circulation of cement upwardly through the flow passages, by means of a seal assembly 27.

Thus, as also described in such patent, the outer surface 26 of the hanger is conically shaped and converges upwardly and inwardly so as to form an upwardly opening frusto-conical space into which the seal assembly 27 has been lowered. More particularly, and again as described in the aforementioned patent, both the casing hanger and the seal assembly are lowered on a running tool (not shown) which, upon landing of the casing hanger, is remotely actuated to lower the seal assembly with respect to the casing hanger body and thus cause it to slide downwardly along the surface 26 and thus be flexed outwardly into sealing engagement with the bore of the casing head. When the seal assembly has been so lowered and installed, both the seal assembly and casing hanger are locked down within the tubing head in any suitable manner as by means described in the aforementioned patent.

In accordance with one novel aspect of the present invention, a tubing hanger 28 comprising a body 29 and a seal assembly 30 carried thereby are lowered by a running tool (not shown) into the bore of the casing head so as to land the tubing hanger in the head above the casing hanger 22 and install and set the seal assembly 30 within an annular space between an outer surface 31 of the tubing hanger and a bore 32 through the casing hanger body. Thus, the seal assembly closes the annular space between the tubing and casing hangers, and thereby prevents well fluid from passing upwardly through the space and flowways in the hanger and into the annular space between the casing hanger 22 and bore of the casing head. As shown, the tubing hanger has an outwardly enlarged portion which carries locking means for locking engagement with the bore of the head in order to hold it down within the bore of the casing head when fully landed therein.

The outer surface 31 of the tubing hanger is conically shaped and converges downwardly so as to form a downwardly opening frusto-conical space between it and the bore 32 of the casing hanger body. Thus, as will be described to follow, upon landing of the seal assembly on the casing hanger, and subsequent lowering of the tubing hanger body with respect to the seal assembly, surface 31 is caused to slide downwardly over the inner side of the seal assembly to cause it to flex outwardly into sealing engagement between the surface 31 and the bore 32 of the casing hanger.

Figure 1:
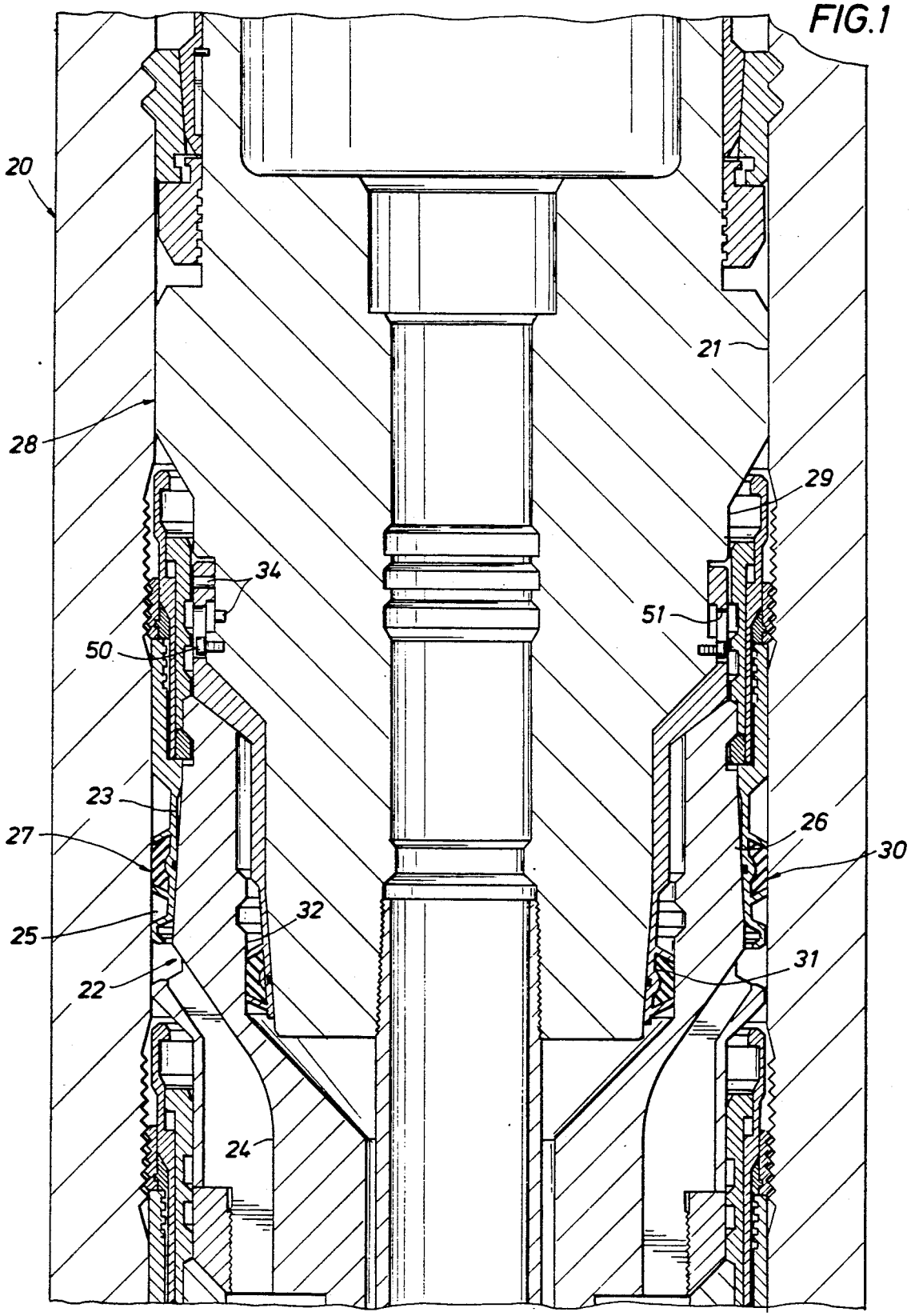
Figure 2:
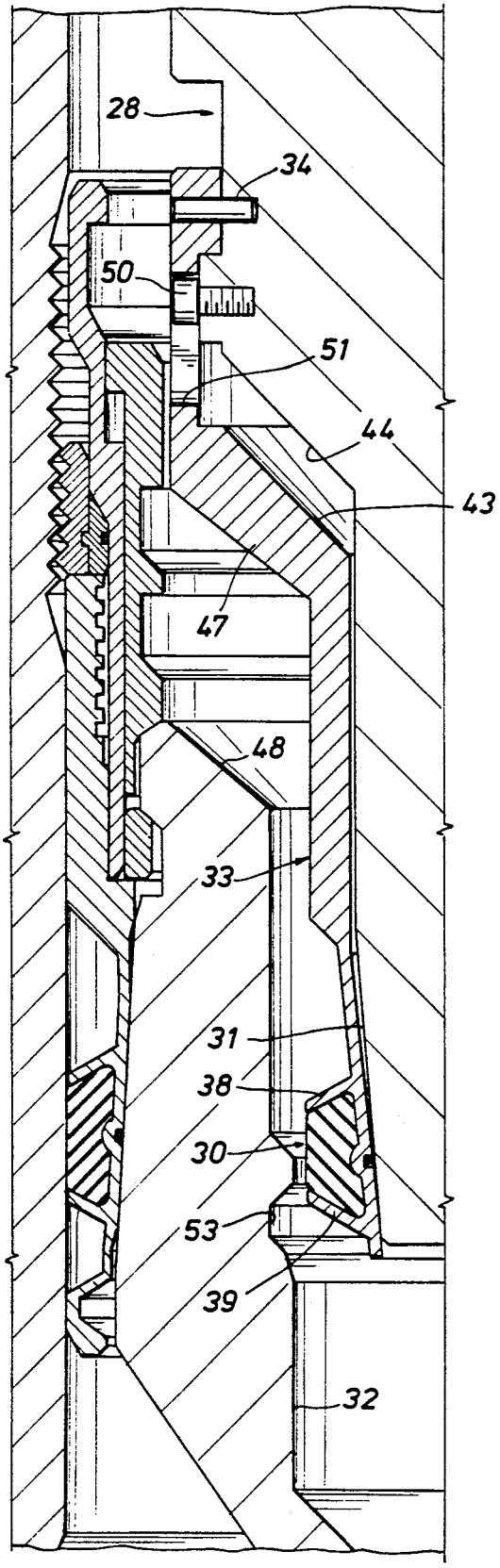
FIG. 2 is an enlarged half sectional view of the portion of the subsea wellhead shown in FIG. 1, but during lowering of the seal assembly with the tubing hanger into the bore of the casing hanger.
Figure 3:
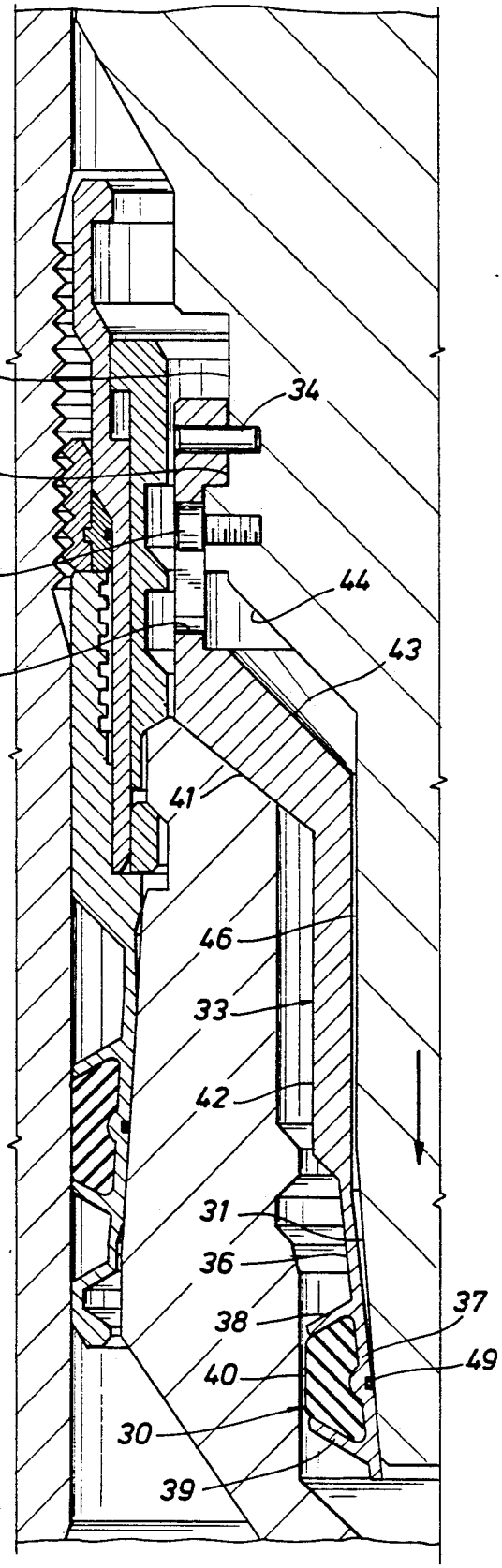
FIG. 3 is a view similar to FIG. 2, but upon further lowering of the hanger and seal assembly to land the seal assembly on the casing hanger.
Figure 4:
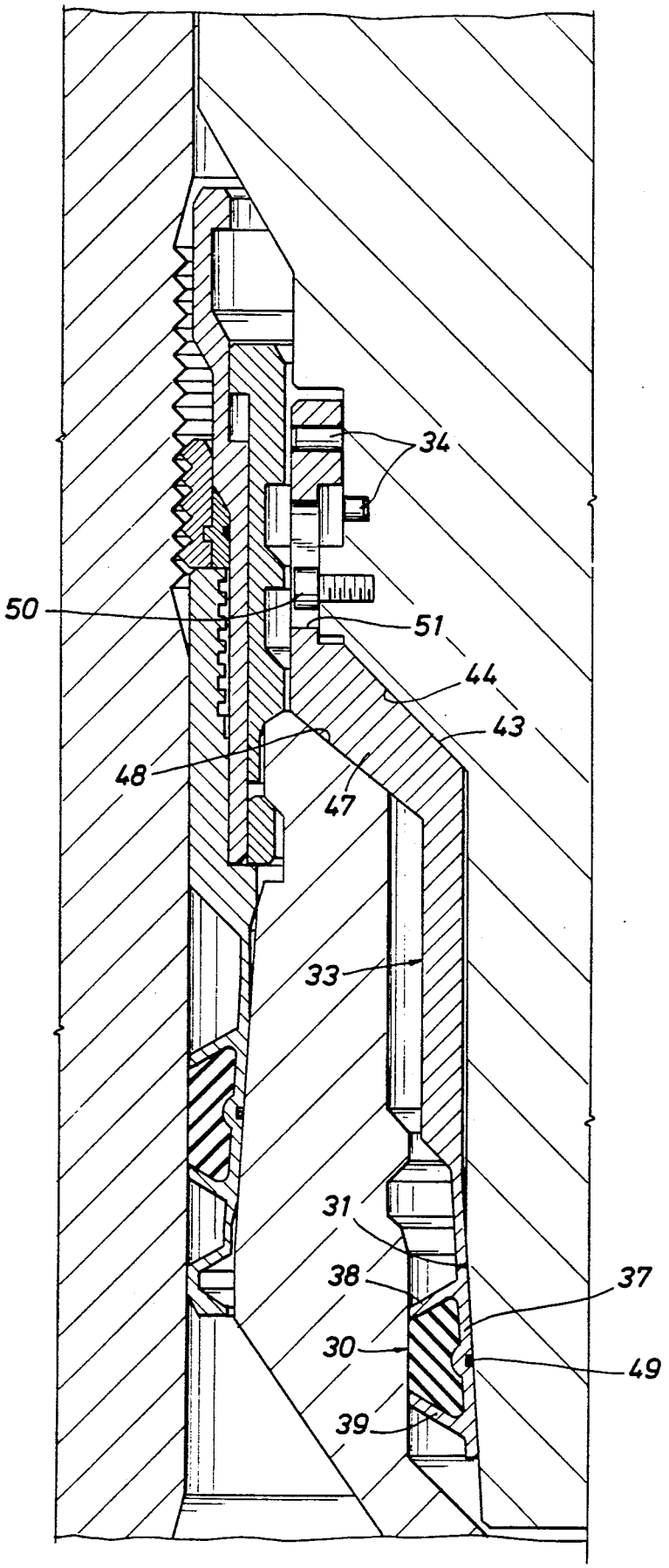
FIG. 4 is a still further view similar to FIG. 3, but upon further lowering of the hanger into landed position on the seal assembly and sliding of its outer surface along the inner wall of the seal assembly body to flex it outwardly and thereby move the outer ends of the legs and packing of the seal assembly into sealing engagement with the bore of the casing hanger.

As best shown in FIG. 2 to 4, the seal assembly 30 includes an annular metal body 33 having an upper end received about and connected by one or more shear pins 34 to a reduced diameter portion 35 of the body of the tubing hanger beneath its upper enlarged end. The body of the seal assembly further includes a relatively thin inner wall 36 at its lower end having a conically shaped inner side 37 for disposal opposite the conically shaped outer surface 31 of the tubing hanger body when the seal assembly is landed.

As shown, and as will be described in more detail to follow, the lower end of the seal assembly body also includes upper and lower legs 38 and 39 which extend respectively outwardly and downwardly and outwardly and upwardly from the outer side of the inner wall 36, and a packing 40 of resilient material confined between the legs and the outer side of the inner wall 36. The outer ends of the legs and the outer surface of the packing are spaced from the bore 32 of the casing hanger body, as the lower end of the seal assembly is lowered into the bore, as shown in FIG. 3, but are adapted to be flexed outwardly into sealing engagement with the bore 32 upon lowering of the tubing hanger body with respect to the seal assembly, following landing of the seal assembly, as will be described in connection with FIG. 4.

The seal assembly body also includes an intermediate wall 41 which is tapered downwardly and inwardly from the upper end of the seal assembly body to an upper extension 42 of the inner wall 36. As shown, a conically shaped seat 43 on the upper side of the wall 41 is spaced beneath a conically shoulder 44 between the reduced diameter portion 35 and a further reduced diameter portion 46 of the tubing hanger body above the outer surface 31 thereof. The outer side of the wall 42 and the inner side of the outer portion 46 of the tubing hanger body are cylindrical and permit free vertical movement of the tubing hanger body with respect to the seal assembly from the position of FIG. 3 to the position of FIG. 4.

As the tubing hanger and seal assembly are lowered onto the casing hanger, the lower side 47 of the wall 43 of the seal assembly body is adapted to land upon a seat or shoulder 48 on the upper end of the tubing hanger body, both surfaces being downwardly and inwardly conically shaped. This then will locate the legs 38 and 39 and packing 40 on the inner wall 36 of the lower end of the seal assembly opposite the cylindrical bore 32 in the tubing hanger body, as shown in FIG. 3. At this time, downward force may be applied to the tubing hanger body, through the running tool, so as to shear pins 34 and thus lower shoulder 44 onto seat 43 to land the tubing hanging body on the seal assembly, and thus land the tubing hanger as well as the seal assembly within the bore of the casing head.

As previously mentioned, this downward movement of the tubing hanger body will cause its outer conical surface 31 to slide downwardly over the inner side 37 of the inner wall of the seal assembly body and thus flex it outwardly to cause the outer ends of the legs 38 and 39 and the outer diameter of the packing 40 to sealably engage the bore 32. A seal ring 49 is carried within a groove about the inner side of the inner wall generally intermediate the legs 38 and 39, a tight seating engagement of the surface 31 with the inner side of the inner wall of the seal assembly.

As described in connection with the aforementioned U.S. Pat. No. 4,757,860, the forcing of the outer ends of the legs 38 and 39 against the bore of the casing hanger will cause the upper leg to be flexed downwardly and inwardly and the lower leg to be flexed upwardly and inwardly thus compressing the packing 40 to cause its outer diameter to be forced outwardly into tight sealing engagement with the bore 32.

The upper end of the seal assembly body also has a lost motion connection with the tubing hanger body which permits the tubing hanger body to move downwardly with respect to the seal assembly, in order to set the seal assembly, but then move upwardly with respect thereto and lift the seal assembly with it in order to retrieve the seal assembly with the tubing hanger, it desired. For this purpose, a screw 50 threaded into the reduced diameter portion 20 of the upper end of the tubing hanger just below the shear pin 34 is received within a slot 51 formed in the upper end of the tubing hanger body and of a length to permit the above described relative movement between the tubing hanger and seal assembly.

As also shown in the drawings, the casing hanger has a groove 53 formed thereabout above the bore 32 which may be useful, for example, in landing one or more tools within the casing hanger during completion of the well.

Although the upper end of this groove may have a diameter substantially smaller than the bore 32, the shear pin 34 holds the inner wall at the lower and of the seal assembly body in a raised position, prior to being flexed inwardly, in which it is retracted beneath the outer surface of the tubing hanger to permit the legs 38 and 39 and packing 40 to be moved freely against the upper end of the groove and into a position opposite the bore 32.

The surface wellhead shown in FIGS. 5 to 9 comprises a casing head or housing 60 having a bore 61 therethrough and connected at its lower end to an outermost casing string (not shown) extending into the well bore. As in the case of the subsea wellhead of FIGS. 1 to 4, the surface wellhead also includes one or more casing hangers 62 lowered into and landed within the bore of the casing head for suspending casing strings therefrom, and an annular space between an outer surface of each of the casing hangers and the bore of the casing head may be closed off following the circulation of cement therethrough during the completion of the well.

In accordance with another novel aspect of the present invention, the surface wellhead also includes a tubing hanger whose body 64 is lowered into the bore of the casing head and landed on the casing hanger 62, as shown in FIG. 5, and a seal assembly 63 for closing the space between an outer surface 66 about the body of the tubing hanger and the bore 61 through the casing head. More particularly, and as will be described more fully hereinafter, the surface 66 is conically shaped to form an upwardly opening frusto-conical space, and the seal assembly is of a shape and construction for flexing outwardly into sealing engagement between the tubing hanger surface and bore so as to close the space. As shown, the tubing hanger carries locking elements 67 which are adapted to be moved into the groove 68 formed in the bore of the casing head so as to hold down the tubing hanger down in the head when landed therein.

The surface wellhead also includes a Christmas tree adapter 68 adapted to be landed on the upper end of the casing head and connected thereto by a connector 69 having locking elements 69A adapted to be cammed into locking engagement with the adapter and head by means of bolts 69B. As shown, the adapter 68 has a bore 70 therethrough including a counterbore 71 at its lower end, and the body of the tubing hanger has an upward tubular extension 72 which is adapted to be received in the counterbore as the Christmas tree adapter is landed on and connected to the casing head. More particularly, the upper extension 72 of the tubing hanger has an outer conical surface 73 which is spaced from the counterbore 31 to form an upwardly facing frusto-conically shaped space between them and a seal assembly 74 is wedged into the space so as to seal with respect both the counterbore 71 and the outer surface 72 of the tubular extension and the us close the space upon landing and connection of the adapter. Thus, like the seal assembly of the subsea wellhead, seal assembly 74 may not be lowered into the space to close it.

Seal assembly 63 is quite similar to the seal assembly of the subsea wellhead previously described, in that it includes a metal body having a relatively thin inner wall 75, and legs 77 and 78 which extend downwardly and outwardly and upwardly and inwardly, respectively, from the outer side of the inner wall, so as to contain a packing 79 of resilient material therebetween. In this case, however, there are two sets of such legs and packings spaced one above the other, thus providing redundant seals.

As in the case of the seal assembly 30, the inner side of the wall 75 is conically tapered downwardly and outwardly for sliding along the outer surface 66 of the tubing hanger body so as to cause the inner wall to be flexed outwardly and thereby cause the outer ends of the legs and the packings to be tightly engaged with the bore of the casing head. As in the case of the seal assembly 63, a seal ring 81 is disposed within a groove about the inner side of the inner wall 75 generally vertically intermediate each upper and lower set of legs to form a resilient as well as a metal-to-metal seal between the seal assembly and the tubing hanger.

In addition to providing redundant seals, the two sets of upper and lower legs define a space 80 between the lower leg of the upper leg of the lower set into which fluid may be injected through a ball check valve 82 in a fitting 83 mounted in the casing head. This may be useful in injecting packing or the like into the space, or in injecting test fluid into the space for testing either or both of the upper and fluid fluid to the packing.

Except for size, the sealing assembly 74 is substantially identical to sealing assembly 65 in that it comprises a metal body having a relatively thin, inner wall 85 having an inner side which is conically shaped downwardly and outwardly to conform generally with the conical shape of the outer surface 73 of the tubular extension 72 for sliding downwardly therealong in order to flex the inner wall outwardly. Seal assembly 74 also includes two vertically spaced apart sets of upper and lower the legs 86 and 87 which extend respectively downwardly and outwardly and upwardly and outwardly from the outer side of the inner wall 85, as well as packing 88 of resilient material confined between each set of upper and lower legs. Thus, upon outward flexing of the inner wall 85, the outer end of the legs and packings are flexed into tight sealing engagement with the counterbore 71, so as to close the annular space between the extension and the counterbore.

As shown in FIGS. 5 and 6, a nut 90 is threadedly connected about the upper end of the body of the tubing hanger for vertical movement with respect to it between an upper position, as shown in FIG. 6, wherein the body of the seal assembly 65 assumes an upper, unflexed position with respect to the tubing hanging body, and a lower position, as shown in FIG. 5, wherein the seal assembly has been forced downwardly to cause its inner wall to slide over the outer surface of the tubing hanger and thus be flexed outwardly into sealing engagement between the tubing hanger and bore of the casing head. As shown in FIG. 6, when in its upper unflexed position, the outer ends of the legs 77 and 78 and packings 79 of the seal assembly are spaced from the bore of the tubing hanger to permit the seal assembly to move freely into the bore of the casing head.

More particularly, the seal assembly body includes a flange 92 at its upper end having a shoulder or seat 93 on its top side engagable by a shoulder 94 on the lower end of the nut 90, and a shoulder 95 which projects inwardly for seating upon a shoulder or seat 96 about the tubing hanger body above the tapered outer surface thereof. As the nut 90 is turned downwardly to lower the seal assembly from the FIG. 5 to the FIG. 6 position and thus flex the inner wall 75 outwardly to tightly engage the outer ends of the legs and the packing with the bore, the shoulder 95 lands on seat 96 to prevent further outward flexing. A C-ring 97 is disposed about grooves in the outer sides of the nut and flange 92 so as to hold them together during assembly.

As previously described, since the tubing hanger is installed in the upper end of the surface casing head, the nut 90 is accessible for manipulation, prior to installation of the Christmas tree adapter, without the need for a long, remotely operated running tool. Instead, the upper end of the nut may be provided with notches or the like to receive conventional tools for torquing it up when the seal assembly is to be set.

In similar fashion, the seal assembly 74 includes a flange 98 at its upper end having a shoulder 99 at its top side adapted to be engaged by a downwardly facing shoulder 100 at the upper end of the counterbore 71 upon assembly of the seal assembly over the upper end of the extension and adapter 73 over the upper end of the seal assembly 74. In that position of the seal assembly, shoulder 101 on the lower end of the inner side of the flange 98 is spaced above shoulder or seat 102 on the upper end of the tubing hanger extension, and the outer ends of the legs 86 and 87 as well as the outer diameter of the packing 88 are spaced from the counter bore in the adapter so that the adapter will move freely over the seal assembly.

As the bolts of the connector 69 are initially made up to connect the adapter to the casing head, shoulder 100 forces the seal assembly body downwardly within the space between the outer surface of the tubing hanger and the bore of the casing head. This causes the inner wall of the seal assembly to slide downwardly over the outer surface of the extension, thereby flexing the inner wall outwardly. Upon continued outward flexing of the inner wall, the outer ends of the legs 86 and 87 as well as the outer diameter of the packing 88 are brought into tight sealing engagement with the counterbore 71 and thus, together with the tight engagement of the inner side of the inner wall and seal rings 103 carried thereabout and the outer surface of the tubing hanger extension, close the space between the extension and adapter. At this time, shoulder 101 moves into engagement with shoulder 102 to limit further downward movement of the seal assembly. Thus, the seal assembly has been installed and set without a running tool or other remotely operable means, and instead merely in response to relative vertical movement between the tubing hanger extension and the tree adapter.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus, comprising a first member having a bore therein, a second member having an outer conical surface thereabout, said first and second members being movable longitudinally with respect to one another into positions in which the conical surface is concentrically within the bore of the first member to form a frusto-conically shaped space between them, and a seal assembly disposable within the space to close same, said seal assembly including an annular metal body comprising a relatively thin, inner wall having an inner conical side for sliding along the outer conical surface of the second member, upon movement in one longitudinal direction with respect to said second member, so as to cause the wall to be flexed outwardly, and spaced legs extending from and surrounding the outer side of the wall, a first of the legs extending toward one end of the wall and a second of the legs extending toward the other end of the wall and having outer ends which are forced tightly against the bore of the first member by outward flexing of the inner wall, one of said members having means for causing said seal assembly body and second member to move in said one longitudinal direction with respect to one another, and said seal assembly having means engagable with said second member, following such movement, to limit outward flexing of said inner wall.

2. Apparatus of the character defined in claim 1, wherein said means for causing the seal assembly body and second member to move with respect to one another comprises a shoulder on the first member at one end of the bore therein engagable with a shoulder on the seal assembly body, as the first member is moved in said one longitudinal direction with respect to said second member, so as to dispose the outer surface of the second member concentrically within the bore of the first member.

3. Apparatus of the character defined in claim 2, wherein the seal assembly is carried by the second member for longitudinal movement with it into the bore of the first member.

4. Apparatus of the character defined in claim 3, wherein the shoulder on the first member extends outwardly from its bore, and the shoulder on the seal assembly body extends outwardly from its inner wall and opposite the shoulder on the first member.

5. Apparatus of the character defined in claim 2, wherein the seal assembly is carried by the second member, and the bore of said first member is movable longitudinally over the seal assembly body.

6. Apparatus of the character defined in claim 5, wherein the shoulder on the first member extends inwardly from the bore, and the shoulder on the seal assembly body extends outwardly from its inner wall and opposite the shoulder on the first member.

7. Apparatus of the character defined in claim 1, wherein the second member has a first part on which the conical surface is formed and a second part which is movable longitudinally with respect to said first part, and said means for moving the seal assembly body comprises a shoulder on the second part engagable with a shoulder on the seal assembly body as the second part is moved in on longitudinal direction with respect to the first part.

8. Apparatus of the character defined in claim 1, including resilient seal means about the outer side of the inner wall on the side of the first leg toward the one end of the wall and on the side of the second leg toward the other end of the wall for sealably engaging the bore, and resilient seal means about the inner side of the inner wall for sealably engaging the outer surface of the second member.

9. Apparatus of the character defined in claim 8, wherein the second leg is above the first leg, and the resilient seal means about the outer side of the inner wall comprises a seal member confined within a recess between the first and second legs.

10. Wellhead equipment, comprising a first wellhead member having a bore therein, a second wellhead member having an outer conical surface thereabout, said first and second members being movable vertically with respect to one another into positions in which the conical surface is concentrically within the bore of the first member to form a frusto-conically shaped space between them, and a seal assembly disposable within the space to close same, said seal assembly including an annular metal body comprising a relatively thin, inner wall having an inner conical side for sliding along the outer conical surface of the second wellhead member, upon movement in one vertical direction with respect to said second wellhead member, so as to cause the wall to be flexed outwardly, and vertically spaced legs extending from and surrounding the outer side of the wall, a first of the legs extending upwardly and a second of the legs extending downwardly from the wall and having outer ends which are forced tightly against the bore of the first wellhead member by outward flexing of the inner wall, one of said wellhead members having means for causing said seal assembly body and second member to move in said one vertical direction with respect to one another, and said seal assembly having means engagable with said second wellhead member, following such movement, to limit outward flexing of said inner wall.

11. Wellhead equipment of the character defined in claim 10, wherein said means for causing the seal assembly body and second member to move with respect to one another comprises a shoulder on the first wellhead member at one end of the bore therein engagable with a shoulder on the seal assembly body, as the first wellhead member is moved in said one vertical direction with respect to said second wellhead member, so as to dispose the outer surface of the second member concentrically within the bore of the first member.

12. Wellhead equipment of the character defined in claim 11, wherein the seal assembly is carried by the second member for longitudinal movement with it into the bore of the first member.

13. Wellhead equipment of the character defined in claim 12, wherein the shoulder on the first wellhead member extends outwardly from its bore, and the shoulder on the seal assembly body extends outwardly from its inner wall and opposite the shoulder on the first member.

14. Wellhead equipment of the character defined in claim 11, wherein the seal assembly is carried by the second wellhead member, and the bore of said first wellhead member is movable longitudinally over the seal assembly body.

15. Wellhead equipment of the character defined in claim 14, wherein the shoulder on the first wellhead member extends inwardly from the bore, and the shoulder on the seal assembly body extends outwardly from its inner wall and opposite the shoulder on the first wellhead member.

16. Wellhead equipment of the character defined in claim 10, wherein the second wellhead member has a first part on which the conical surface is formed and a second part which is movable vertically with respect to said first part, and said means for moving the seal assembly body comprises a shoulder on the second part engagable with a shoulder on the seal assembly body as the second part is moved in one vertical direction with respect to the first part.

17. Wellhead equipment of the character defined in claim 10, including resilient seal means about the outer side of the inner wall the side of the first leg toward the one end of the wall and on the side of the second leg toward the other end of the wall for sealably engaging the bore, and resilient seal means about the inner side of the inner wall for sealably engaging the outer surface of the second member.

18. Wellhead equipment of the character defined in claim 17, wherein the second leg is above the first leg, and the resilient seal means about the outer side of the inner wall comprises a seal member confined within a recess between the first and second legs.

19. Wellhead equipment, comprising a housing having a bore therethrough and connectable to the upper end of an outer pipe string, a first hanger body including a body having a bore therethrough and connectable to an intermediate pipe string for lowering into a landed positioned within the bore of the housing to suspend the intermediate pipe string within the outer pipe string, and means for sealing between the first hanger body and the bore of the housing, a second hanger including a body connectable to the upper end of an inner pipe string and adapted to be lowered into a landed position in the housing to suspend the inner pipe string within the intermediate pipe string, and said second hanger body having an upper end which fits closely within the housing bore and an outer downwardly and inwardly tapered conical surface about its lower end which forms a frusto-conically shaped annular space between it and an inner surface of the bore of the first hanger body when landed in the housing, and a seal assembly for closing the space, said seal assembly having a metal body which is carried by the second hanger body for lowering therewith into a landed position within the bore of the first hanger body and which is releasable therefrom upon landing and continued lowering of the second hanger body with respect to the first hanger body, and said seal assembly body having an inner wall whose inner conical side is tapered downwardly and inwardly for sliding over the outer surface of the second hanger body to cause the inner wall to be flexed outwardly as the second hanger body is lowered with respect to the seal assembly body, and a pair of vertically spaced legs extending from and surrounding the outer side of the inner wall, a first of the legs extending upwardly and a second of the legs extending downwardly from the wall so that the first leg is flexed upwardly and the second leg is flexed downwardly as their outer ends are forced against the inner surface of the bore of the first hanger body by outward flexing of the inner wall of the seal assembly body.

20. Wellhead equipment of the character defined in claim 19, wherein the first hanger body has a seat thereabout, and the seal assembly body has a shoulder landable on the seat.

21. Wellhead equipment of the character defined in claim 20, wherein the seal assembly body has a seat thereabout, and the second hanger body has a shoulder thereon landably on the seat of the seal assembly body.

22. Wellhead equipment of the character defined in claim 19, wherein the second hanger body has means for engaging and lifting the seal assembly with it upon raising of the second hanger body from within the bore of the first hanger body.

23. Wellhead equipment of the character defined in claim 19, including resilient seal means about the outer side of the inner wall above the first leg and below the second leg for sealably engaging the bore, and resilient seal means about the inner side of the inner wall for sealably engaging the outer surface of the tubing hanger body.

24. Wellhead equipment of the character defined in claim 23, wherein the second leg is above the first leg, and the resilient seal means about the outer side of the inner wall comprises a seal member confined within a recess between the first and second legs.

* * * * *